US011828528B2

(12) United States Patent
Shi et al.

(10) Patent No.: US 11,828,528 B2
(45) **Date of Patent: *Nov. 28, 2023**

(54) WATER DISPENSER

(71) Applicant: Electrolux Home Products, Inc., Charlotte, NC (US)

(72) Inventors: Zhuochen Shi, Anderson, SC (US); Josh Hanson, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/854,313

(22) Filed: Jun. 30, 2022

(65) Prior Publication Data

US 2022/0333849 A1 Oct. 20, 2022

Related U.S. Application Data

(63) Continuation of application No. 16/929,217, filed on Jul. 15, 2020, now Pat. No. 11,408,667, which is a (Continued)

(51) Int. Cl.
*F25D 23/04* (2006.01)
*F25D 23/12* (2006.01)
(Continued)

(52) U.S. Cl.
CPC ..... *F25D 23/126* (2013.01); *B67D 1/1444* (2013.01); *F25C 5/22* (2018.01);
(Continued)

(58) Field of Classification Search
CPC ..... F25C 5/22; B67D 1/00; B67D 1/1444; B67D 2001/1483; B67D 2210/00036; F25D 23/028; F25D 23/04; F25D 23/126
See application file for complete search history.

(56) References Cited

U.S. PATENT DOCUMENTS 1,936,517 A 11/1933 Maine
2,020,963 A 11/1935 Reid
(Continued)

FOREIGN PATENT DOCUMENTS

DE 102010062737 6/2012
KR 20120090687 8/2012

OTHER PUBLICATIONS

International Search Report for PCT/US2018/065587, dated Mar. 11, 2019, 3 pages.

*Primary Examiner* — Filip Zec
(74) *Attorney, Agent, or Firm* — Pearne & Gordon LLP

(57) ABSTRACT

A water dispenser for a refrigerator including a water discharge nozzle fluidly connected to a water source, a valve configured to selectively block the fluid connection, and an actuator operated to allow water to be dispensed. The water discharge nozzle is pivotally mounted to a surface of the refrigerator to pivot between a retracted position and an extended position. In the extended position, the water discharge nozzle is extended outwards beyond the surface of the refrigerator. The water discharge nozzle is biased towards one of the extended and retracted positions. The valve is configured to block the fluid connection between the water discharge nozzle and the water source when the water discharge nozzle is in the retracted position. When the water discharge nozzle pivots to the extended position, the valve is operated to enable fluid connection between the water discharge nozzle and the water source.

20 Claims, 7 Drawing Sheets

Related U.S. Application Data continuation of application No. 15/849,007, filed on Dec. 20, 2017, now Pat. No. 10,739,063.

(51) Int. Cl.

| | |
|---|---|
| ***B67D 1/14*** | (2006.01) |
| ***F25C 5/20*** | (2018.01) |
| *F25D 23/02* | (2006.01) |
| *B67D 1/00* | (2006.01) |

(52) U.S. Cl.

CPC ..... *F25D 23/04* (2013.01); *B67D 1/00* (2013.01); *B67D 2001/1483* (2013.01); *B67D 2210/00036* (2013.01); *F25D 23/028* (2013.01)

(56) References Cited

U.S. PATENT DOCUMENTS

| | | | | |
|---|---|---|---|---|
| 2,276,937 | A | 11/1935 | Cordova | |
| 2,512,395 | A | 6/1950 | Sundberg | |
| 2,553,693 | A | 5/1951 | Wehr | |
| 2,744,390 | A | 5/1956 | Partsch | |
| 3,476,295 | A | 11/1969 | Telfer | |
| 5,542,265 | A | 8/1996 | Rutland | |
| 6,425,425 | B2 | 7/2002 | Bianchi | |
| 6,574,984 | B1 | 6/2003 | McCrea et al. | |
| 6,810,682 | B1 | 11/2004 | Schuchart et al. | |
| 6,964,352 | B2 | 11/2005 | Werth | |
| 7,007,500 | B2 | 3/2006 | Lee | |
| 7,340,915 | B2 * | 3/2008 | Kwon | F25D 23/02 62/324.4 |
| 7,455,085 | B2 | 11/2008 | Voglewede et al. | |
| 7,757,732 | B2 | 7/2010 | Voglewede et al. | |
| 7,793,690 | B2 | 9/2010 | Voglewede et al. | |
| 7,997,452 | B2 | 8/2011 | Kim et al. | |
| 8,011,203 | B1 | 9/2011 | Schenk et al. | |
| 8,646,288 | B2 | 2/2014 | Lim et al. | |
| 8,701,436 | B2 | 4/2014 | Kim | |
| 8,820,583 | B2 | 9/2014 | Kim | |
| 8,966,927 | B2 * | 3/2015 | Eckartsberg | F16B 5/0208 62/389 |
| 9,085,453 | B2 | 7/2015 | McMahan et al. | |
| 9,175,894 | B2 | 11/2015 | Mitchell | |
| 9,557,097 | B2 | 1/2017 | McMahan et al. | |
| 9,890,029 | B2 | 2/2018 | Comsa et al. | |
| 10,473,386 | B2 * | 11/2019 | Cakirca | F25D 23/126 |
| 10,663,219 | B2 * | 5/2020 | Alyanak | F25C 5/22 |
| 2007/0157641 | A1 | 7/2007 | Ferragut | |
| 2008/0163641 | A1 * | 7/2008 | Mitchell | B67D 1/0875 239/18 |
| 2008/0202147 | A1 | 8/2008 | Lim et al. | |
| 2009/0008403 | A1 | 1/2009 | Lee et al. | |
| 2010/0175417 | A1 | 7/2010 | Kim | |
| 2011/0209493 | A1 | 9/2011 | Schenk et al. | |
| 2011/0283734 | A1 * | 11/2011 | Koo | F25D 23/126 62/389 |
| 2012/0024003 | A1 * | 2/2012 | Kim | F25D 23/126 62/389 |
| 2012/0207894 | A1 | 8/2012 | Webster | |
| 2015/0053302 | A1 | 2/2015 | Willis et al. | |
| 2015/0300729 | A1 | 10/2015 | Seo et al. | |
| 2017/0003069 | A1 | 1/2017 | Moertl et al. | |
| 2017/0016665 | A1 * | 1/2017 | Lachermeier | F25D 23/126 |
| 2017/0137277 | A1 | 5/2017 | Comsa et al. | |
| 2017/0307284 | A1 * | 10/2017 | Kim | F25D 23/028 |
| 2018/0050898 | A1 | 2/2018 | McMahan et al. | |
| 2018/0094850 | A1 | 4/2018 | Temizkan et al. | |
| 2018/0094851 | A1 | 4/2018 | Temizkan et al. | |
| 2018/0094852 | A1 | 4/2018 | Temizkan et al. | |
| 2018/0099857 | A1 | 4/2018 | Comsa et al. | |
| 2018/0100685 | A1 | 4/2018 | Park | |
| 2019/0093942 | A1 * | 3/2019 | Scalf | B67D 3/0009 |
| 2019/0219318 | A1 | 7/2019 | Ercher et al. | |
| 2020/0029725 | A1 | 1/2020 | Wantland | |

* cited by examiner

WATER DISPENSER

CROSS-REFERENCE TO RELATED APPLICATIONS

This application is a continuation of U.S. application Ser. No. 16/929,217 filed on Jul. 15, 2020, which is a continuation of U.S. application Ser. No. 15/849,007 filed on Dec. 20, 2017. These applications are incorporated herein by reference.

FIELD OF THE INVENTION

This following description relates generally to a refrigeration appliance and, more particularly, to a refrigeration appliance including a water dispenser provided with a rotatable water discharge nozzle and a switch to activate the discharge of the water.

BACKGROUND

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventionally, refrigerators have a water (and/or ice) dispenser located on the front surface of the refrigerator door. This allows a user to obtain water that is chilled by a water circulation system in the refrigerator or ice created by an ice maker while the refrigerator door is closed.

In the conventional dispenser described above, the passage and devices for dispensing the water and ice must be provided along the front and rear of the door. Additionally, because of the space necessary on the front of the door for accommodating the dispenser, the door may become deformed during the molding process. Further, a clean appearance of the face of the refrigerator door is interrupted by the conventional dispenser.

BRIEF SUMMARY

In accordance with one aspect, there is provided a water dispenser for a refrigerator comprising a water discharge nozzle fluidly connected to a water source, a valve configured to block the fluid connection, and an actuator. The water discharge nozzle is pivotally mounted to a surface of the refrigerator to pivot between a retracted position and an extended position. In the extended position the water discharge nozzle extends outwards beyond the surface of the refrigerator. The water discharge nozzle is biased toward the retracted position. The valve is configured to selectively block the fluid connection when the water discharge nozzle is in the retracted position. The actuator is operated to allow water to be dispensed from the water discharge nozzle by pivoting the water discharge nozzle to the extended position and operating the valve to thereby enable fluid connection between the water discharge nozzle and the water source.

In one version, the water discharge nozzle can be at least partially surrounded by a water discharge housing that connects the water discharge nozzle to a pivot point. In another version, the actuator can be an elongate curved body. The actuator can be attached to the water discharge nozzle by a mechanical linkage such that the amount of rotation of the water discharge nozzle is correlated to the amount of the rotation of the elongate body. The water discharge nozzle can be rotatably mounted to a support structure mounted to the surface of the refrigerator. The support structure can include a rectangular frame, a back wall extending partially along the frame, and an aperture extending through the back wall. A portion of the elongate body can extend through the aperture.

In a further version, a refrigeration appliance can include a cabinet defining a compartment, a pair of doors pivotally connected to the cabinet, and the water dispenser attached to at least one door. The door include an exterior face that is exposed to an ambient environment of the refrigeration appliance, an interior portion that is exposed to an interior of the compartment while the door is closed, and a side portion extending between the exterior face and the interior portion of the door, the side portions of the doors generally oppose each other when the doors are closed. The water dispenser is mounted to the side portion of the door. The water discharge nozzle can be at least partially surrounded by a water discharge housing that is flush with the side portion of at least one of the doors when the water discharge nozzle is in the retracted position. The actuator can comprise an actuator case, a push button mounted to the case, and an actuator component disposed in a space defined by the actuator case and the push button. The actuator case includes a bottom face, a side face, and an upper face having an opening and the push button is mounted so as to close the opening. The push button is configured to travel between a rest position where a front face of the push button is flush with the upper face, and an activated position where the push button is at least partially displaced into the space. The push button is biased toward the rest position, and in the rest position, the push button is flush with the side portion of at least one of the doors.

In accordance with another aspect, there is provided there a water dispenser for a refrigerator comprising a water discharge nozzle fluidly connected to a water source, a valve configured to block the fluid connection, and an actuator. The water discharge nozzle is pivotally mounted to a surface of the refrigerator to pivot between a retracted position and an extended position. In the extended position the water discharge nozzle extends outwards beyond the surface of the refrigerator. The water discharge nozzle is biased toward the extended position. The water discharge nozzle includes a push-push locking mechanism configured to secure the water discharge nozzle in either the retracted position or extended position. The valve is configured to selectively block the fluid connection when the water discharge nozzle is in the retracted position. The actuator is operated to allow water to be dispensed from the water discharge nozzle by activating the valve to enable fluid connection between the water discharge nozzle and the water source when the water discharge nozzle is pivoted to the extended position.

In a version of this aspect, the water discharge nozzle is at least partially surrounded by a water discharge housing that connects the water discharge nozzle to a pivot point. The push-push locking mechanism can include an arcuate path indented on an outer surface of the water discharge housing and the water dispenser further includes a pin configured to cooperate with and travel along the arcuate path. The pin and arcuate path can be configured to prevent further outward pivoting of the water discharge nozzle once the water discharge nozzle reaches the extended position.

In another version, the actuator comprises a push button with a front surface and an opposing back surface adjacent a first electric switch. The first electric switch can be connected to the valve by an electric circuit. The water dispenser can further include a sensor configured to detect when the water discharge nozzle is in the extended position and to enable the electric circuit when the water discharge nozzle is in the extended position. Alternatively, the water dispenser can include a sensor configured to detect when the water discharge nozzle is in the extended position and each of the first electric switch and the sensor send separate signals to the valve or a driving electric circuit for the value. The valve then operates to enable fluid connection between the water discharge nozzle and the water source when both signals are received.

In a further version, a refrigeration appliance with a cabinet defining a compartment and a liner extending around at least a portion of an interior surface of the cabinet includes the water dispenser pivotally mounted to the liner. The water discharge nozzle can be at least partially surrounded by a water discharge housing that connects the water discharge nozzle to a pivot point and is flush with the liner when the water discharge nozzle is in the retracted position. The switch can include a push button with a front surface that is biased toward the rest position and when in the rest position the front surface is flush with the side portion of at least one of the doors.

DESCRIPTION OF EXAMPLE EMBODIMENTS

Figure 1:
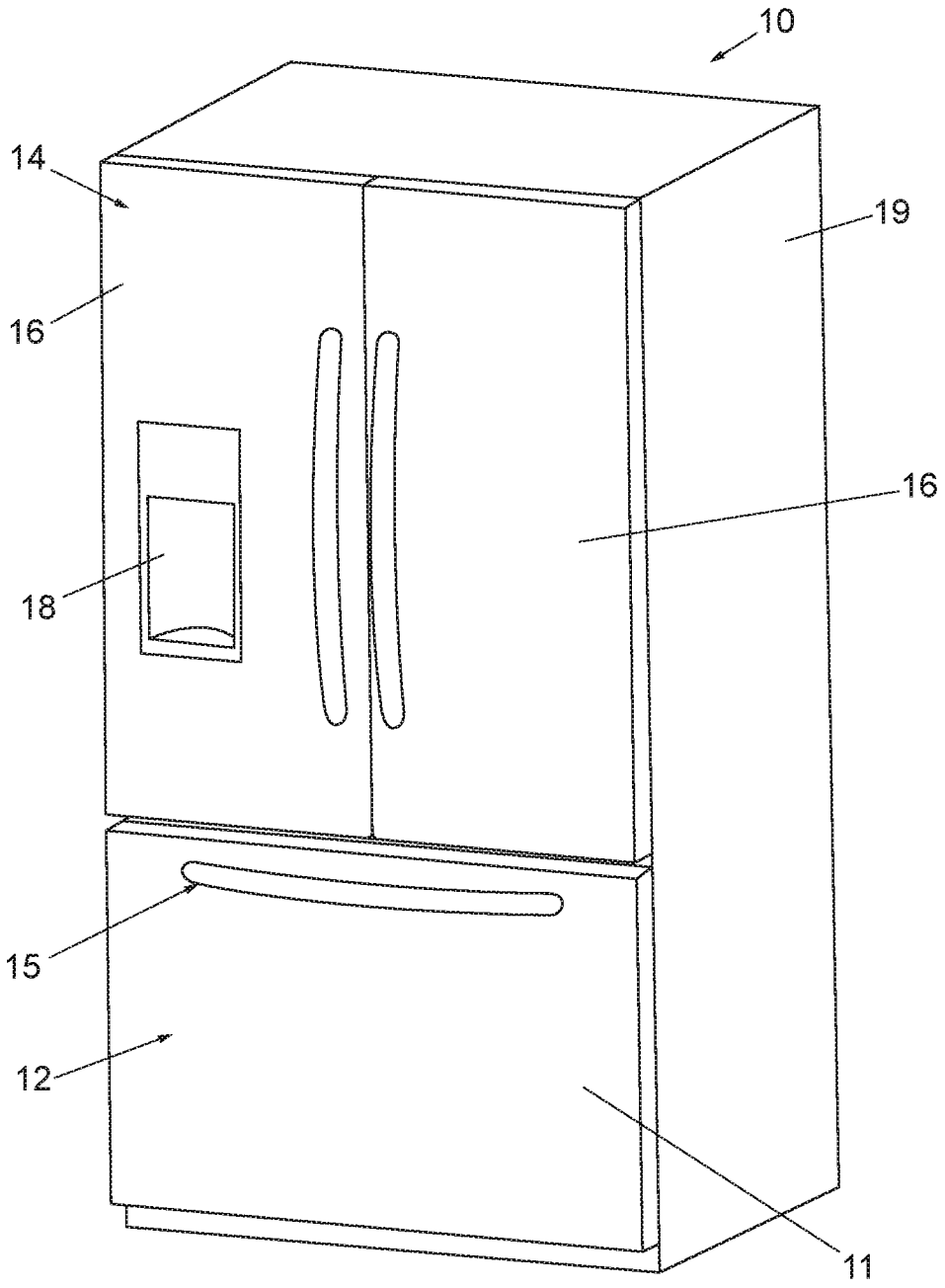
FIG. 1 is a front perspective view of a prior-art household French Door Bottom Mount refrigerator wherein doors of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Figure 2:
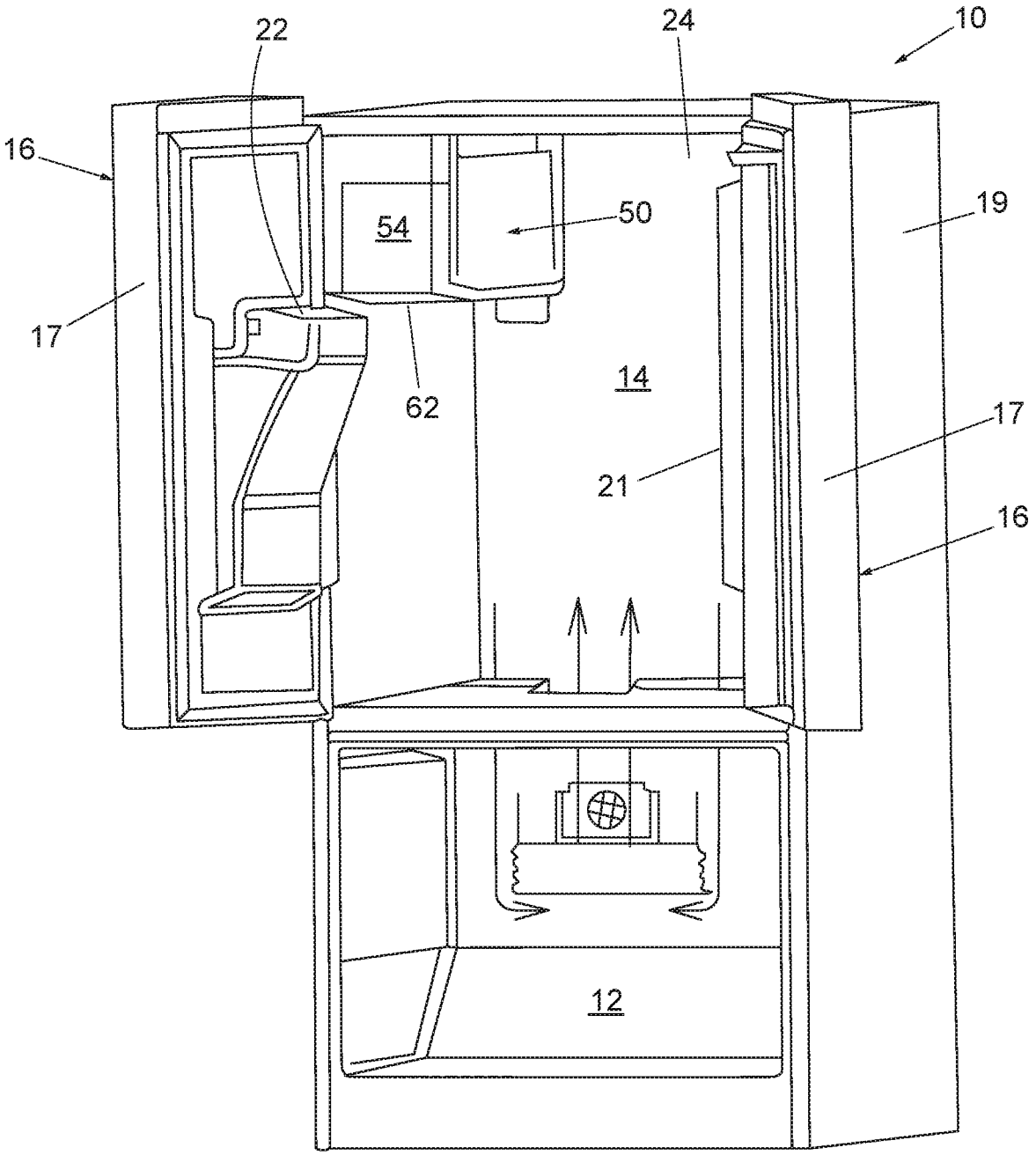
FIG. 2 is a front perspective view of the refrigerator of FIG. 1 showing the doors in an opened position and an interior of a fresh food compartment.

Referring now to the drawings, FIGS. 1 and 2 show a refrigeration appliance, in the form of a domestic refrigerator, indicated generally at 10 with a dispenser 18 according to the prior art. One or more doors 16 are pivotally coupled to a cabinet 19 of the refrigerator 10 to restrict and grant access to a chilled compartment 14. In the prior art, the dispenser 18 (FIG. 1) for dispensing at least one of ice pieces and water is provided on an exterior of one of the doors 16 that restricts access to the chilled compartment 14. The dispenser 18 includes a cavity recessed into the door 16 to form a take-out space for inserting a container (e.g. cup, pitcher, bowl, etc.) to collect the ice pieces and/or water.

The dispenser 18 includes a first actuator (e.g., lever, switch, proximity sensor, etc.) to cause frozen ice pieces to be dispensed from an ice bin 54 (FIG. 2) of an ice maker 50 disposed within the chilled compartment 14. Ice pieces from the ice bin 54 can exit the ice bin 54 through an aperture 62 and be delivered to the dispenser 18 via an ice chute 22 (FIG. 2), which extends at least partially through the door 16 between the dispenser 18 and the ice bin 54.

The dispenser 18 further includes a second actuator (e.g. lever, switch, proximity sensor, etc.) to cause water to be dispensed from a water nozzle. In one embodiment, the dispenser can be connected to an overall water flow system for the refrigeration appliance. The water flow system can carry water through or adjacent to the chilled compartment 14 such that water carried by the system is chilled before being dispensed from the water nozzle.

The refrigeration appliance will now be described in detail. The water dispenser 26 of the present invention is used in the shown refrigeration appliance in lieu of the illustrated dispenser 18 and the corresponding dispenser structure. The refrigeration appliance structure discussed in detail below can be shared by both the prior art dispenser 18 and the water dispenser 26 according to the present invention.

Although the detailed description that follows concerns a domestic refrigerator 10, the invention can be embodied by refrigeration appliances other than with the domestic refrigerator 10. Further, an embodiment is described in detail below, and shown in the figures as a bottom-mount configuration of the refrigerator 10, including the chilled compartment 14 acting as a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotally coupled to the cabinet 19 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In the illustrated embodiments, the ice maker 50 is located within the fresh food compartment 14. In alternative embodiments, the ice maker 50 is located within the freezer compartment 12. In this configuration, although still disposed within the freezer compartment 12, at least the ice maker 50 (and possibly an ice bin 54) is mounted to an interior surface of the freezer door 11. It is contemplated that the ice mold and ice bin 54 can be separate elements, in which one remains within the freezer compartment 12 and the other is on the freezer door 11.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

In an embodiment of the present invention, the refrigerator 10 shown in FIGS. 1 and 2, briefly described above and described in detail below, includes a water dispenser 26 according to the present invention in lieu of the dispenser 18 and corresponding dispenser structure. It is appreciated that removing the dispenser 18 of the prior art additionally removes the corresponding ice dispensing structure on the interior of the door 16, including the ice chute 22 and the corresponding aperture 62 in the ice bin 54. However, it is contemplated that the water dispenser 26 of this application could be used together with and/or in addition to the prior art dispenser 18, if desired.

Turning to the water dispenser 26 according to the present invention, various embodiments are shown in FIGS. 3-10. In an embodiment, the water dispenser 26 comprises a water discharge nozzle 28 fluidly connected to a water source (e.g. household water line, shown schematically with a dashed line), which includes a water line 30, a valve (shown schematically at 32) configured to block the fluid connection between the water discharge nozzle 28 and the water source, and an actuator 34 operated actuate the valve 32 and to allow water to be dispensed from the water discharge nozzle 28.

In one embodiment, the water discharge nozzle 28 is pivotally mounted to a surface of the refrigerator 10 accessible to a user. The water discharge nozzle 28 can pivot between a retracted position and an extended position. In the extended position, the water discharge nozzle 28 extends at an angle outwards beyond the surface of the refrigerator 10. In a first embodiment, the angle is between 45° and 90° relative to said surface of the refrigerator 10. In a second embodiment, the angle is less than 45° but greater than 0°, preferably about 20°-35°, relative to said surface of the refrigerator 10. The water discharge nozzle 28 can extend outwardly beyond the surface of the refrigerator 10 at any chosen angle.

In an embodiment, the water discharge nozzle 28 is mounted to the surface of the refrigerator 10 via a support structure 36 that is secured to the surface of the refrigerator 10. In the embodiment illustrated in FIG. 3, the support structure 36 comprises a hollow open-faced rectangular body 38 defining a support structure interior space. The support structure 36 of this embodiment can further include a flange 40 extending along a periphery of the open-face. In this embodiment, the support structure 36 can be mounted to the surface of the refrigerator such that the open face is flush with the surface of the refrigerator and the user can access the interior space. In the alternative, the support structure 36 is mounted to the surface such that the open face is indented from the surface or the open face is spaced outward from the surface.

Figure 4:
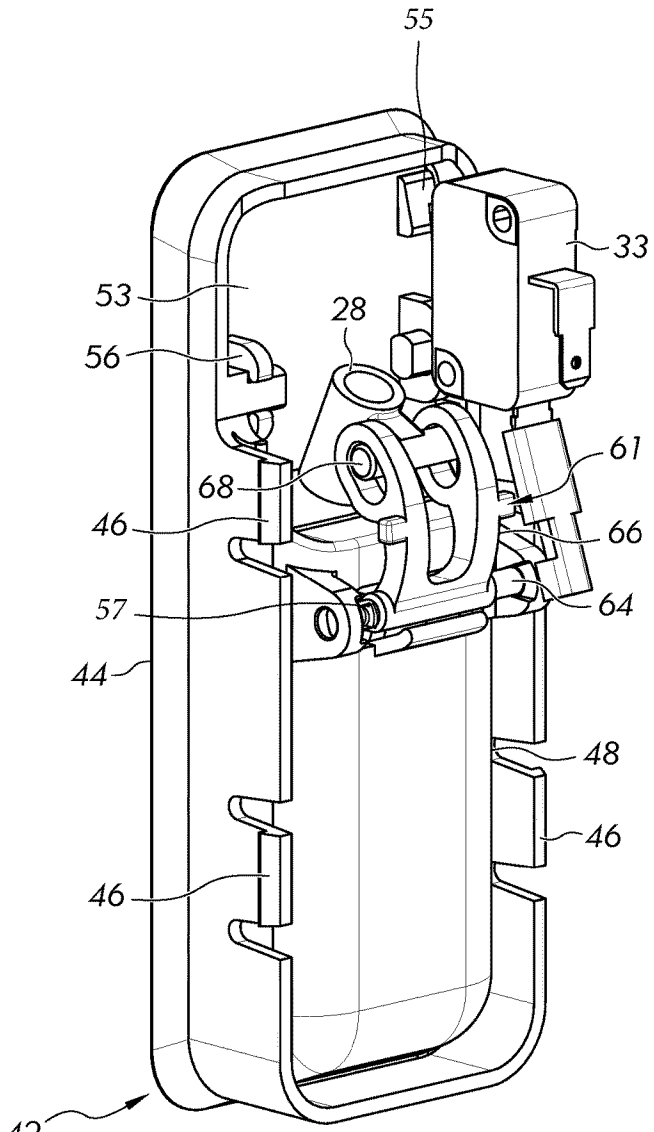
FIG. 4 is a rear perspective view of a portion of the water dispenser embodiment of FIG. 3.
Figure 3:
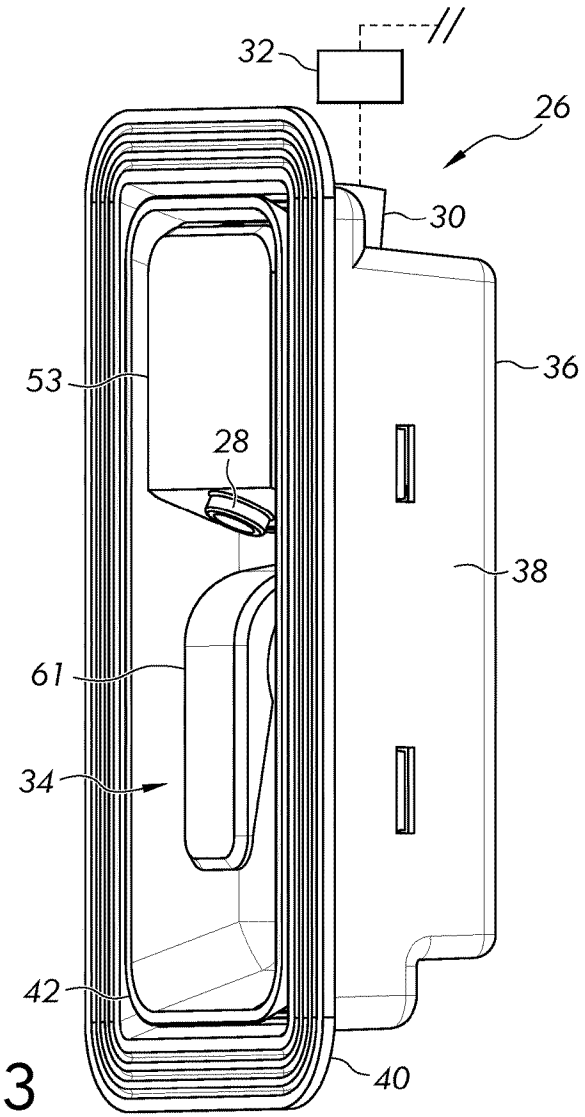
FIG. 3 is a front perspective view of a water dispenser according to a first embodiment.
Figure 6:
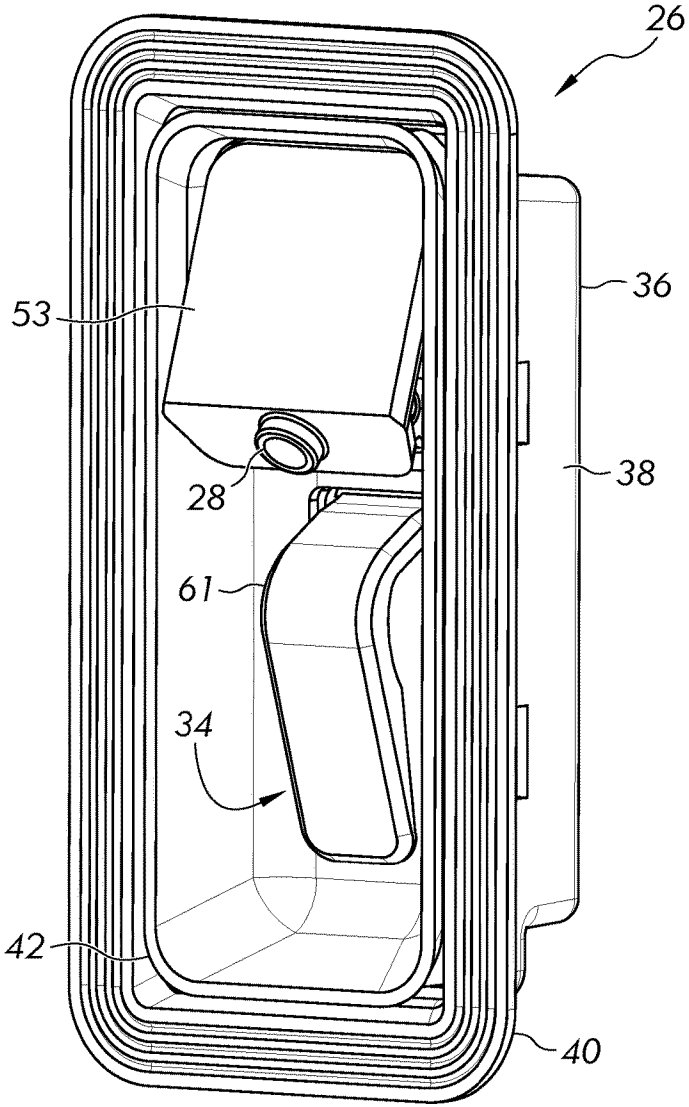
FIG. 6 is a front perspective view of the water dispenser embodiment of FIG. 3 in a dispensing position.

The water discharge nozzle 28 can be mounted in the interior space via a support frame 42, illustrated in FIGS. 3 and 4. In the illustrated embodiment, the support frame 42 is a hollow rectangular frame 44 dimensioned to fit within the support structure interior space. The support frame 42 further includes one or more protrusions 46 extending from the frame 44. The protrusions 46 are configured to interact with and connect to an inner surface of the support structure 36. The protrusions 46 can include flexible arms that snap fit into corresponding holes in the support structure 36, or other appropriate connection structure. The support frame 42 can further include a back wall 48 extending partially along the frame 44. The back wall 48 can be depressed outwardly from a point where the back wall 48 attaches to the frame 44. The back wall 48 can include one or more apertures extending therethrough.

The water discharge nozzle 28 can be at least partially surrounded by a water discharge housing 53. The water discharge housing 53 can be connected to a pivot point such that rotation of the water discharge housing 53 causes rotation of the water discharge nozzle 28. As illustrated in FIG. 3 in an embodiment of the retracted position, the water discharge housing 53 can be substantially flush with the open face of the support structure 36.

The pivot point can be located on the support frame 42 such that the water discharge housing 53 rotates with respect to the support frame 42. As illustrated in FIG. 4, the water discharge housing 53 includes a plurality of fingers 56 configured to snap around a bar in the support frame 42 to rotate about the bar.

In one embodiment, the water discharge nozzle 28 is connected to the water line 30 and is in fluid communication with a source of fluid. The source of fluid can comprise an external water source that drives water through water valves, a water tank, and/or a filter before arriving at the water line 30. However any suitable source of fluid is contemplated.

The valve or similar structure (shown schematically at 32) can be configured to block fluid connection between the water discharge nozzle 28 and the water source when the water discharge nozzle 28 is in the recessed position. The valve 32 or similar structure can be further configured to allow fluid connection between the water discharge nozzle 28 and the water source when the water discharge nozzle 28 is in the extended position.

In an embodiment, the valve 32 is an electronically actuated solenoid valve 32. In this embodiment, the solenoid valve 32 is configured to only be energized when the water discharge nozzle 28 reaches the extended position. This can be achieved by a sensor 33, such as an electrical switch, that determines the location of the water discharge nozzle 28. Various types of electrical switches can be used, such as various contact or non-contact switches. In one example, the sensor 33 can be a normally open switch, which closes upon actuation by an externally applied force, or vice-versa. For example, the water discharge housing 53 can include a cam projection 55 that engages with the sensor 33 when the water discharge housing 53 rotates to the extended positon. In another example, the switch could be a non-contact capacitive or magnetic switch, or the like. In another embodiment, the sensor 33 can be triggered when the water discharge nozzle 28 reaches the extended position.

The actuator 34 can be operated to pivot the water discharge nozzle 28 to the extended position. Similar to the water discharge nozzle 28, the actuator 34 can be secured to a surface of the refrigerator 10 directly. The actuator 34 can also be secured to the surface of the refrigerator 10 by the same support structure 36 the water discharge nozzle 28 is attached to or by a separate support structure secured to the surface of the refrigerator 10. In the illustrated embodiments, the actuator 34 is secured to the same support structure 36 that the water discharge nozzle 28 is secured to.

The actuator 34 can be activated by a user to cause the water discharge nozzle 28 to pivot to the extended position. In a first embodiment, shown in FIG. 3, the water discharge nozzle 28 and the actuator 34 are mechanically connected. In another embodiment, the water discharge nozzle 28 and the actuator 34 are electronically connected. Any suitable connection between the actuator 34 and the water discharge nozzle 28 is contemplated.

The actuator 34 can be connected to the surface of the refrigerator to move linearly, rotationally, or any preferred direction with respect to the surface in response to a user. The amount of pivoting that the water discharge nozzle 28 experiences can be a function of the movement of the actuator 34. For example, where a user only bumps the actuator 34, i.e. accidentally presses the actuator 34, the water discharge nozzle 28 will not pivot to the extended position and will prevent water from discharging onto the user. Whereas, if a user applies enough force to the actuator 34, the water discharge nozzle 28 will pivot to the extended position and discharge water.

Figure 5:
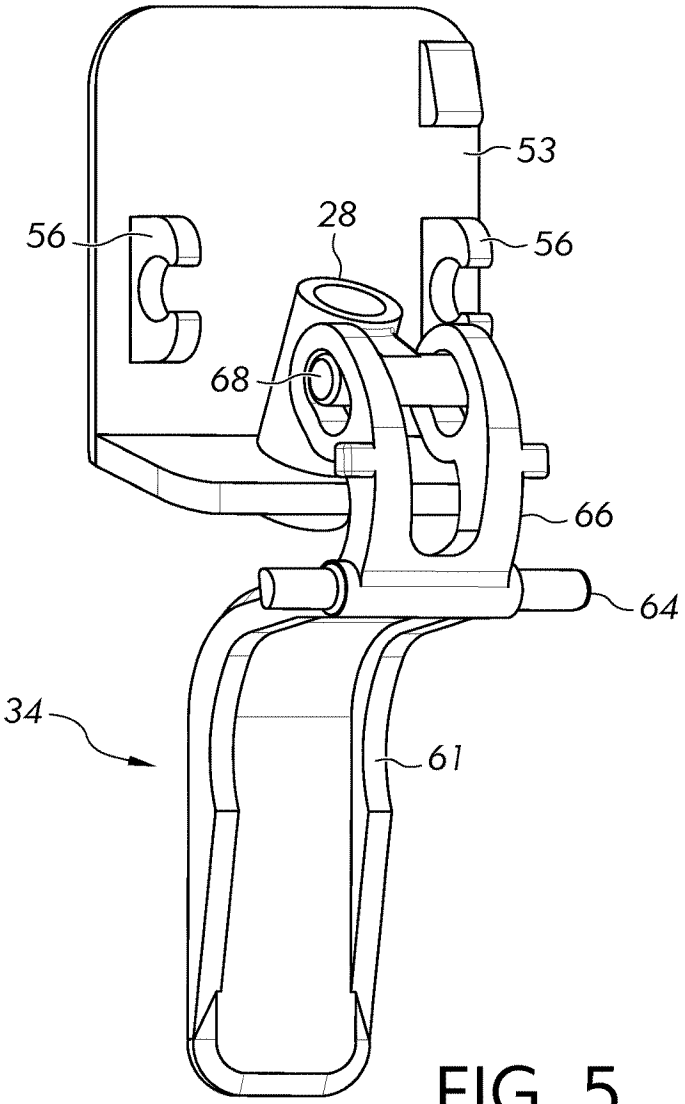
FIG. 5 is rear perspective detail view of a portion of the water dispenser embodiment of FIG. 4.

In one embodiment, shown in FIG. 5, the actuator 34 is an elongate curved body 61. In this embodiment, a portion of the curved body 61 extends through one aperture in the support frame 42. The actuator 34 further includes laterally extending cylindrical protrusions 64 configured to rotatably attach to the support frame 42. The cylindrical protrusions 64 allow the actuator 34 to rotate with respect to the support frame 42. The curved body 61 further includes one or more arms 66 configured to mechanically connect the actuator 34 to the water discharge nozzle 28. In the illustrated embodiment, the curved body 61 includes two parallel arms 66 with oblong apertures formed therein that attach to a bar 68 that is attached to the water discharge nozzle 28 and/or water discharge housing 53.

The actuator 34 can include one or more spring(s) 57 (shown schematically) configured to bias the actuator 34 outwards toward a first position, shown in FIG. 3, when not pressed by a user. In one example, the spring 57 could be a torsion spring, operatively positioned at the cylindrical protrusions 64 or the fingers 56 to bias the actuator 34 to the counter-clockwise position as shown in FIG. 3. Various other types and configurations of springs could be used, such as a coil spring, leaf spring, etc. Since the actuator 34 and the water discharge housing 53 are mechanically connected, the spring attached to the actuator 34 would also bias the water discharge housing 53 inwards toward the retracted position. Alternatively, the water discharge housing 53 is biased toward the retracted position by an attached spring and since the actuator 34 is mechanically connected to the water discharge housing 53, the actuator 34 is biased toward the first position. In a yet further alternative, both the water discharge housing 53 and the actuator 34 each have a biasing member that biases them towards the retracted position and the first position respectively.

A method of dispensing water according to a first embodiment, shown in FIGS. 3-6, will now be described. First, a user presses on the actuator 34 causing the actuator 34 to rotate counter-clockwise (as shown in FIG. 3) with respect to the support frame 42. The counter-clockwise rotation of the actuator 34 causes the actuator arms 66 to rotate and the interior surface of the oblong apertures press against the bar 68 attached to the water discharge nozzle 28 and/or water discharge housing 53, thereby causing the water discharge nozzle 28 to rotate outwards clockwise with respect to the support frame 42. When the sensor 33 determines that water discharge nozzle 28 and/or water discharge housing 53 has rotated to the extended position, the solenoid valve 32 is activated and establishes fluid connection between the water source and the water discharge nozzle 28. For example, the sensor 33 determines the extended position by engagement between a moveable element (e.g., some portion of the actuator 34 or water discharge housing 53) and the switch 33 (or a non-contact equivalent, if suitable), such as when the cam projection 55 engages with the sensor 33. When the user determines that they have received the desired amount of water, the user stops pressing the actuator 34 and the spring causes the actuator 34 to rotate clockwise to return to the first position. As the actuator 34 rotates clockwise, the actuator arms 66 pull on the bar 68 causing the water discharge nozzle 28 and/or water discharge housing 53 to rotate counter-clockwise and return to the retracted position. As soon as the sensor 33 determines that the water discharge nozzle 28 is no longer in the extended position, the solenoid valve 32 is deactivated blocking the fluid connection between the water source and the water discharge nozzle 28.

Turning now to FIGS. 7-10, a second embodiment of the water dispenser will be described. In this second embodiment, shown in FIG. 7, the support structure 36 comprises a planar body 51 with one or more apertures extending therethrough and at least one protrusion 52 extending perpendicularly from the planar body 51. In this embodiment, the support structure 36 can be mounted to the surface of the refrigerator such that the planar body 51 is flush with the surface of the refrigerator. The water discharge nozzle 28 can be mounted in one of the apertures. The water discharge housing 53 can be substantially flush with the planar surface of the support structure 36 in the retracted position.

Figure 8:
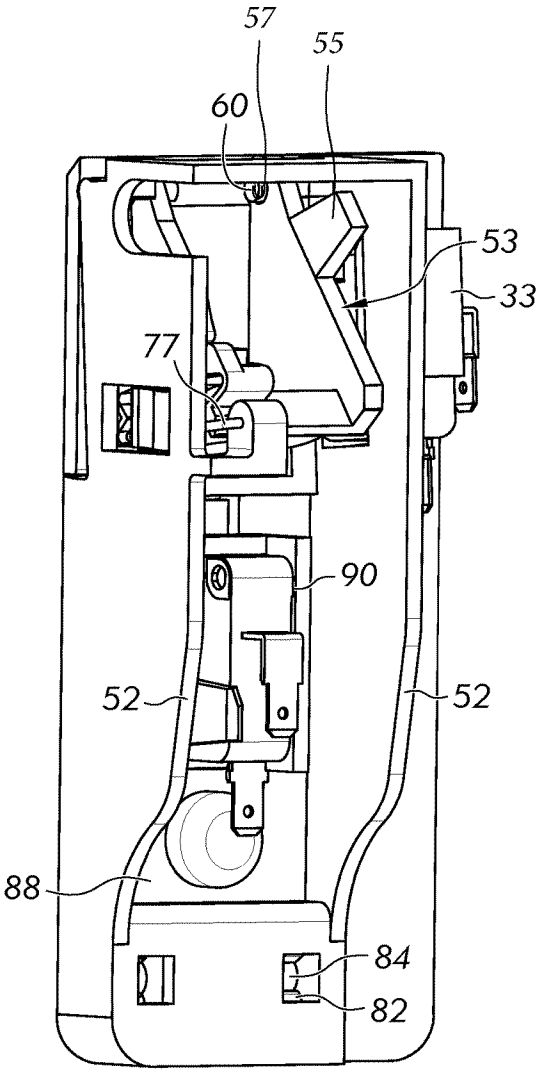
FIG. 8 is a rear perspective view of the water dispenser embodiment of FIG. 7.
Figure 9:
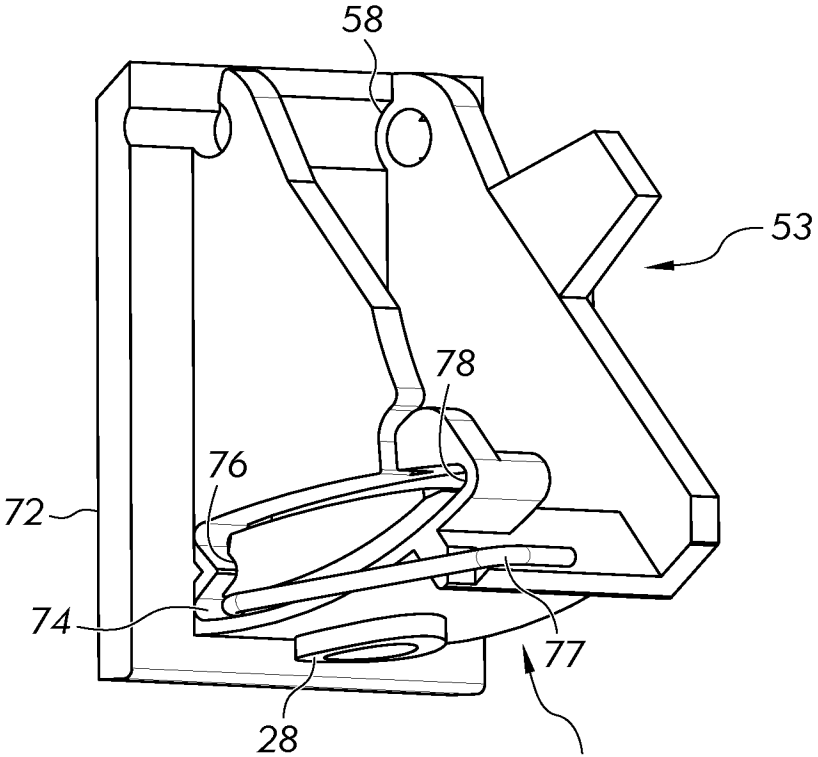
FIG. 9 is a rear perspective detail view of a portion of the water dispenser embodiment of FIG. 7.

Returning to the water discharge housing 53, as shown in FIGS. 9, the water discharge housing 53 can include a so called push-push locking mechanism, indicated generally at 70, whereby rotation of the water discharge housing 53 and water discharge nozzle 28 is caused by a user pressing on an outer surface 72 of the water discharge housing 53. As illustrated in FIGS. 8 and 9, the water discharge housing 53 includes a protrusion 58 with a circular aperture allowing the water discharge housing 53 to rotate about one or more bars 60 in the support structure 36. In the push-push locking mechanism 70, a path 74 with at least two points 76, 78 is formed on the device. Preferably, the path 74 is not symmetrical so that the pin 77 only moves along the path 74 in a single direction. A retaining finger or pin 77 moves along the path 74 between a first position at a first point 76 and a second position at a second point 78.

Figure 7:
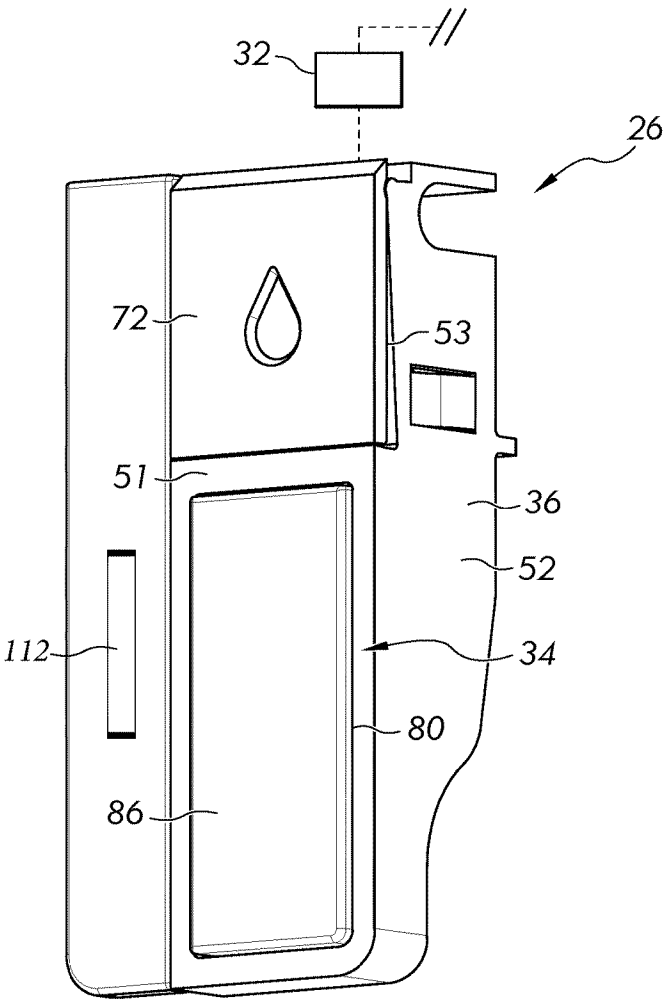
FIG. 7 is a front perspective view of a water dispenser according to a second embodiment.
Figure 10:
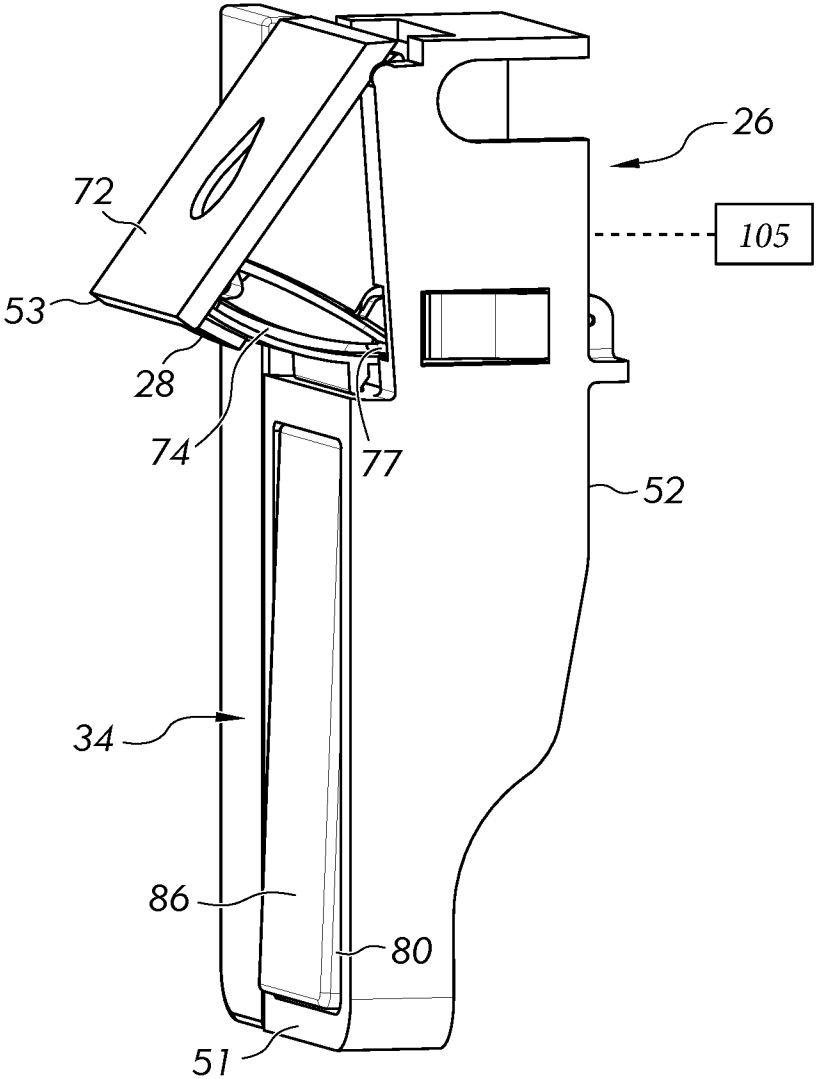
FIG. 10 is a front perspective view of the water dispenser embodiment of FIG. 7 in a dispensing position.

In the illustrated embodiment of FIG. 7, the first position is the retracted position. In this position the retaining finger 77 is secured at the first point 76 by the shape of the path 74. The water discharge housing 53 is biased toward the extended position by a biasing member (e.g. spring 57, which can be a torsion spring, coil spring, leaf spring, etc.) which pushes the water discharge housing 53 against the retaining finger 77. If a user presses against the outer surface 72 of the water discharge housing 53 with enough pressure to overcome the biasing spring, the retraining finger disengages the first point 76 and travels along the path 74 toward the second point 78. When the retaining finger 77 reaches the second point 78, the water discharge housing 53 is in the extended position (see FIG. 10). The spring 57 can be located variously, such as being operatively connected to the water discharge housing 53 about the pivot bars 60 or other suitable location.

If a user wishes to return the water discharge housing 53 to the retracted position, the user again presses against the outer surface 72 of the water discharge housing 53 which causes the retaining finger 77 to disengage from the second point 78 and travel along the path 74 toward the first point 76. The path 74 is configured such that the retaining finger 77 can travel along two different paths, a first one when the retaining finger 77 travels between the first point 76 and the second point 78, and a second one when the retaining finger 77 travels between the second point 78 and the first point 76.

In a push-push water discharge housing configuration, both the water discharge housing 53 and an end of the retaining finger 77 are secured to the support structure 36 such that the water discharge housing 53 can rotate with respect to the support structure 36. The retaining finger 77 can act as a lock type mechanism to prevent the water discharge housing 53 from rotating too far in either a clockwise or counter-clockwise direction.

In an embodiment of the water dispenser 26 illustrated in FIGS. 7 and 8, the actuator 34 can include a push button 80 rotatably mounted to the support structure 36. The push button 80 includes curved fingers 82 configured to snap on and rotate about circular bars 84 on the support structure 36. The push button 80 is configured to rotate between a first position and a second position, and is biased toward the first position. The push button 80 includes a front surface 86 facing a user and a back surface 88 opposite the front surface 86. The back surface 88 is adjacent a first electric switch 90 such that rotation of the push button 80 activates the first electric switch 90. The first electric switch 90 is further connected to the solenoid valve 32 between the water discharge nozzle 28 and the water source. The support structure 36 can further include a wall spanning the protrusions 52 to define a space between the wall, the protrusions 52, and the push button 80. The first electric switch 90 would be located in the space.

A method of dispensing water according to a second embodiment, shown in FIGS. 7-10, will now be described. First, a user presses on the outer surface 72 of the water discharge housing 53 causing the retaining finger 77 to disengage from the first point 76. The water discharge housing 53 will then rotate counter-clockwise while the retaining finger 77 travels along the path 74 toward the second point 78. When the retaining finger 77 reaches the second point 78 the water discharge housing 53 will be in the extended position. The user can then press on the front surface 86 of the push button 80 causing the push button 80 to rotate clockwise from the first position toward the second position. As the push button 80 rotates clockwise the first electric switch 90 is activated. A sensor 33 determines if the water discharge housing 53 is at the extended position, and if it is, the sensor 33 establishes a link between the first electric switch 90 and the valve 32. The sensor 33 can be an electric switch as previously discussed herein. Additionally, the water discharge housing 53 can include a cam projection 55 as previously discussed herein that engages with the sensor 33, such as a switch, when the water discharge housing 53 moves to the extended position. If the valve 32 receives a signal from the first electric switch 90, a fluid connection is established between the water discharge nozzle 28 and the source. However, if the water discharge housing 53 is not at the extended position, the sensor 33 does not create a link between the first electric switch 90 and the valve 32 so even if the first electric switch 90 is activated the water will not discharge through the water discharge nozzle 28. Thus, in this example, the first electric switch 90 and sensor 33 could be in series so that both must be actuated for the valve 32 to permit water to flow. Although it has been described herein as either or both of the sensor 33 and first electric switch 90 as sending a signal to or being in electrical communication with the valve 32, it is understood this description is intended to include both direct electrical communication and also indirect electrical communication whereby these elements are connected indirectly via a driving electrical circuit. For example, in one alternative, the first electric switch 90 and the sensor 33 may both provide sensor inputs to a main control board of the refrigerator (e.g., a main electronic control circuit of the refrigerator including analog and/or digital control circuitry) which utilizes its own decision making circuitry or logic to control operation of the valve 32. Thus, for example in the first embodiment, the valve 32 may be opened to discharge water when the actuator 34 is pivoted and a moveable element (e.g., some portion of the actuator 34, water discharge housing 53, or other element moved thereby) engages the sensor 33 (such as switch). The sensor 33 input to the main control board is used an input by the main control board to determine that the water valve 32 should be actuated open to allow the flow of water. Similarly, in the second embodiment, both of the sensor 33 and first electric switch 90 can send signals to the main control board (e.g., the first electric switch 90 indicates the user call for water by the push button 80, and the sensor 33 is engaged by a moveable element of the water discharge housing 53 (or other element moved thereby) when it is pivoted to the extended position), thereby enabling the main control board to use both of these inputs to determine that the water valve 32 should be actuated open to allow the flow of water.

When a user determines that they have received the desired amount of water, the user stops pressing the push button 80. As the push button 80 rotates back toward the first position the first electric switch 90 is deactivated and stops sending a signal to the valve 32, which deactivates and blocks the fluid communication between the water discharge nozzle 28 and the water source. The user can then press on the outer surface 72 of the water discharge housing 53 causing the water discharge housing 53 to rotate counter-clockwise and the retaining finger 77 to travel along the path 74 from the second point 78 toward the first point 76 as the water discharge housing 53 returns to the retracted position.

The illustrated embodiments show the actuator 34 adjacent and below the water discharge housing 53 however the actuator 34 can be located at any preferred position on a surface of the refrigerator with respect to the water discharge housing 53. For example, where the water discharge housing 53 and the actuator 34 are mechanically linked it may be advantageous for the water discharge housing 53 and the actuator 34 to be adjacent. Whereas, when the water discharge housing 53 and the actuator 34 are connected electronically by switches, the actuator 34 can be located at a position spaced from the water discharge housing 53.

It is further contemplated in an alternative embodiment that the water discharge housing 53 could be operated by a motor 105 to move between the extended and retracted positions. For example, as shown schematically in FIG. 10, an electric motor 105 can be used to directly drive the water discharge housing 53, such as by rotation about elements 58, 60, or even indirectly drive the water discharge housing 53 by an intermediate operating structure. In one example, the motor 105 could even be used in connection with the push-push mechanism described herein, where the motor 105 moves the water discharge housing 53 a sufficient amount to operate movement of the retaining finger 77 to travel along the path 74 between the first and second points 76, 78.

The motor 105 can be operated in various manners. In one example, the motor 105 can be driven upon the user actuating the push button 80 to call for water dispensing. In another example, various non-contact sensors 112 (shown schematically in FIG. 7) can be used to sense the presence of a user's hand and/or liquid vessel (e.g., water cup, carafe, pitcher, etc.) next to the water dispenser. In one embodiment, when the non-contact sensor 112 senses the presence of a user's hand and/or liquid vessel, a control circuit (e.g., a dedicated control circuit or the main refrigerator control board) can drive the motor 105 to drive the water discharge housing 53 to the extended position. Thereafter, the control circuit could operate the water valve 32 automatically when the water discharge housing 53 is sensed by sensor 33 to be fully extended and the liquid vessel is sensed, or alternatively, the control circuit could operate the water valve 32 only after (and/or while) the user presses the push button 80. Thereafter, when the push button 80 is no longer pressed or when the sensor 112 senses removal of the liquid vessel, the control circuit can operate the motor 105 to move the water discharge housing 53 back to the retracted position. Various known non-contact sensors 112 can be utilized, including proximity sensors and/or motion sensors, such as an infrared (IR) sensor, a capacitive sensor, inductive sensor, optical sensor, photoelectric sensor, etc. Other example non-contact sensors 112 can include a magnetic sensor such as described in U.S. Publication No. 2017/0137277 or capacitive sensors of U.S. Pat. Nos. 9,085,453 or 9,557,097, or other proximity sensors as described in U.S. Publication No. 2015/0053302, all of which are incorporated by reference herein in their entirety.

As discussed above, the water dispenser 26 of the present invention can be mounted on any surface accessible to the user. It may be preferable to mount the water dispenser 26 in a position other than the exterior of the refrigerator 10 so as to provide a clean look to the front of the refrigerator 10. In an embodiment, the water dispenser 26 is mounted on a side surface 17 of the door 16 (see FIG. 2) so that a user can access the water dispenser 26 without having to completely open the chilled compartment 14. In another embodiment, the water dispenser 26 is mounted on the interior liner 24 of the chilled compartment 14. In a yet further embodiment, the water dispenser 26 is mounted to an interior surface of the door 16. Any number and location(s) of the water dispenser 26 consistent with the desired use is hereby contemplated.

Any of the above described embodiments of the water dispenser 26 can be attached to the surface of the refrigerator 10, however it may be preferable to use different embodiments depending on the chosen surface. For example, it may be preferable to use the embodiment illustrated in FIGS. 3-6 when the water dispenser 26 is located on the side surface 17 (FIG. 2) of the door 16. It may be preferable that the actuator 34 and the water discharge housing 53 are mechanically linked so that after a user finishes dispensing water and stops pressing on the actuator 34 the water discharge housing 53 automatically rotates back to the retracted position. This can help prevent a user from accidentally closing the door 16 while the water discharge housing 53 is in the extended position and potentially damaging the water discharge housing 53, the side surface 17, an adjacent door 16, the mullion 21, or any combination thereof.

Figure 11:
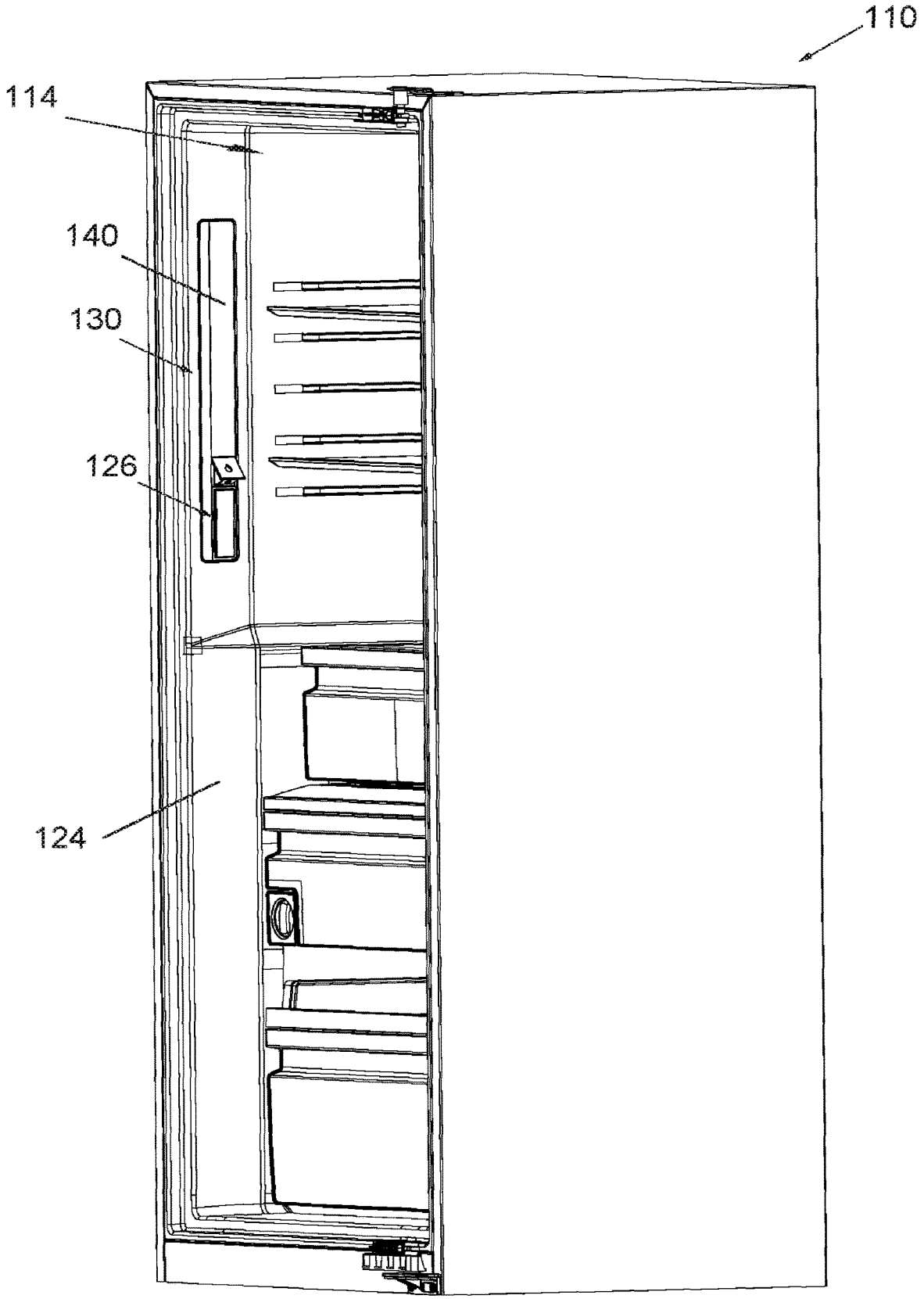
FIG. 11 is a front perspective view of a refrigerator with a combined water dispenser and illumination assembly.

Turning to FIG. 11, a further embodiment is illustrated. A domestic refrigerator, indicated generally at 110, includes a chilled compartment 114 that is accessible via one or more doors (not shown) pivotally coupled to the cabinet of the refrigerator 110 to restrict and grant access thereto. The refrigerator 110 includes an interior liner 124 that defines the fresh food compartment 114. Although illustrated as a dedicated refrigerator with only a fresh food compartment, it is contemplated that the refrigerator 110 could also have a freezer compartment in any known configuration (top mount, bottom mount, side by side, etc.). In this embodiment, a combined assembly 130 includes the water dispenser 126 in combination with an illumination assembly 140 for the fresh food compartment 114. The combined assembly 130 includes a single housing that is coupled to an exposed face of the interior liner 124. In other words, the combined assembly includes both of the water dispenser and illumination assembly in a single housing mounted to the liner. Preferably, the combined assembly 130 is flush mounted into a single recess of the interior liner 124 such that both of the water dispenser 126 in the retracted position, and the illumination assembly 140, are similarly flush with (or raised slightly above) the surface of the interior liner 124. Optionally, the water dispenser 126 and the illumination assembly 140 can share a combined electrical wire assembly or electrical wire block connected to a power supply and/or the main refrigerator control circuit board. Thus, the combined assembly 130 simplifies assembly and manufacturing of the refrigerator 110, while also providing a clean appearance of the interior liner 124 that is substantially free of other obstructions. The water dispenser 126 could be any of the water dispensers discussed herein, such as that of FIGS. 3-6 or FIGS. 7-10. The illumination assembly 140 preferably includes an illumination source to illuminate the interior of the fresh food compartment 114 when the door is opened, and can utilize any suitable illumination element(s). For example, the illumination assembly 140 can include an array of LED lights or incandescent bulbs. The illumination assembly 140 can be located at various locations relative to the water dispenser 126, such as vertically above (as shown), vertically below, and/or on either or both sides. In one example, the illumination assembly 140 can be an elongated shape that extends vertically along the liner. Lastly, although illustrated on an interior side wall of the liner 124, it is contemplated that the combined assembly 130 could be located at any position discussed herein for the water dispenser, such as on the refrigerator door, etc.

In a different example, it may be preferable to use the embodiment illustrated in FIGS. 7-10 when the water dispenser 26 is located on the interior liner 24 or interior surface of the door 16 (FIG. 2). In this arrangement, it may be preferable that the water discharge housing 53 and actuator 34 are not mechanically linked. This is to prevent the water discharge housing 53 from rotating and dispensing water uncontrollably when items stored in the chilled compartment 14 shift and start pressing on the actuator 34. In addition, it may be preferable to place the water discharge housing 53 and the actuator 34 at different locations on the interior liner 24.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A dispenser for a refrigerator appliance, the dispenser comprising:

a support structure;

a discharge housing pivotally attached to the support structure and configured to rotate between retracted and extended positions, wherein the discharge housing defines a path in a side wall thereof to receive a pin adapted to move along the path and between a first end point corresponding to the retracted position and a second end point corresponding to the extended position; and a motor operable to rotate the discharge housing between the retracted and extended positions.

2. The dispenser according to claim 1, wherein the dispenser comprises a push button movably mounted to the support structure and operable to actuate the motor to rotate the discharge housing between the retracted and extended positions.

3. The dispenser according to claim 1, wherein the discharge housing comprises a discharge nozzle, and wherein the dispenser comprises a valve operable to open and close a fluid connection between an external water source and the discharge nozzle.

4. The dispenser according to claim 3, wherein the dispenser further comprises:

a sensor adapted to open the valve to establish the fluid connection between the external water source and the discharge nozzle when the discharge housing is in the extended position.

5. The dispenser according to claim 4, wherein the sensor comprises an electric switch, and wherein the discharge housing comprises a projection adapted to engage the electric switch when the discharge housing is in the extended position to thereby establish the fluid connection.

6. The dispenser according to claim 5, wherein the dispenser further comprises:

a first switch; and a push button operable to engage the first switch to facilitate establishing the fluid connection.

7. The dispenser according to claim 6, wherein the push button is rotatably mounted to the support structure and configured to engage the first switch upon an inward rotation thereof.

8. The dispenser according to claim 1, wherein the support structure includes a bar, and wherein the dispenser comprises a push button movably mounted to the support structure and operable to actuate the motor to rotate the discharge housing between the retracted and extended positions, wherein the push button includes a finger adapted to snap onto the bar and rotate thereabout.

9. The dispenser according to claim 1, wherein the discharge housing is configured to rotate to the retracted position when the pin moves toward the first end point, and wherein the discharge housing is configured to rotate to the extended position when the pin moves toward the second end point.

10. The dispenser according to claim 1, wherein the motor is configured to facilitate moving the pin between the first and second end points.

11. A refrigerator appliance comprising:

an interior liner defining a storage compartment;

a dispenser located on the interior liner, wherein the dispenser comprises:

a discharge housing adapted to pivot relative to the liner between retracted and extended positions, wherein the discharge housing defines a path in a side wall thereof to receive a pin adapted to move along the path and between a first end point corresponding to the retracted position and a second end point corresponding to the extended position; and a motor operable to pivot the discharge housing between the retracted and extended positions.

12. The refrigerator appliance according to claim 11, wherein the dispenser comprises a support structure, and wherein the discharge housing is pivotally attached to the support structure.

13. The refrigerator appliance according to claim 12, wherein the support structure is mounted to an interior surface of the refrigerator appliance.

14. The refrigerator appliance according to claim 11, wherein the dispenser comprises a push button movably mounted to an interior surface of the appliance and operable to actuate the motor to rotate the discharge housing between the retracted and extended positions.

15. The refrigerator appliance according to claim 11, wherein the discharge housing comprises a discharge nozzle, and wherein the dispenser comprises a valve operable to open or close a fluid connection between an external water source and the discharge nozzle.

16. The refrigerator appliance according to claim 15, wherein the dispenser further comprises:

a sensor adapted to open the valve to establish the fluid connection between the external water source and the discharge nozzle when the discharge housing is in the extended position.

17. The refrigerator appliance according to claim 16, wherein the sensor comprises an electric switch, and wherein the discharge housing comprises a projection adapted to engage the electric switch when the discharge housing is in the extended position to thereby open the fluid connection.

18. The refrigerator appliance according to claim 11, wherein the discharge housing is configured to rotate to the retracted position when the pin moves toward the first end point, and wherein the discharge housing is configured to rotate to the extended position when the pin moves toward the second end point.

19. The refrigerator appliance according to claim 11, wherein the motor is configured to facilitate moving the pin between the first and second end points.

20. The refrigerator appliance according to claim 11, wherein the dispenser comprises:

a support structure with a bar; and a push button movably mounted to the support structure and operable to actuate the motor to pivot the discharge housing between the retracted and extended positions, wherein the push button includes a finger adapted to snap onto the bar and rotate thereabout.

* * * * *